United States Patent [19]

Veuilleumier et al.

[11] 3,969,888

[45] July 20, 1976

[54] DRIVING MECHANISM FOR DAY-DATE CALENDAR DEVICE

[76] Inventors: Cyril Veuilleumier, Chemin de Beaumont 64, 2500 Bienne; André Triponez, Lyss-Str. 75, 2560 Nidau; Jean-Pierre Schindler, Chemin des Alouettes 10, 2710 Tavannes; Michel Schwab, Allee de la Champagne 42, 2502 Bienne, all of Switzerland

[22] Filed: Dec. 10, 1973

[21] Appl. No.: 423,186

[30] Foreign Application Priority Data

Dec. 11, 1972 Switzerland ..... 18006/72
Jan. 18, 1973 Switzerland ..... 669/73

[52] U.S. Cl. ..... 58/58; 74/112; 74/436

[51] Int. Cl.[2] ..... G04B 19/24

[58] Field of Search ..... 74/112, 436; 58/58, 58/85.5

[56] References Cited

UNITED STATES PATENTS

| | | | |
|---|---|---|---|
| 3,470,687 | 10/1969 | Tsuneyoshi Oho et al. | 58/58 |
| 3,470,688 | 10/1969 | Miyasaka | 58/85.5 |
| 3,616,641 | 12/1971 | Komori | 58/58 |
| 3,645,090 | 2/1972 | Mochizuki et al. | 58/58 |
| 3,693,344 | 9/1972 | Cleusix | 58/85.5 |
| 3,695,035 | 10/1972 | Cleusix | 58/85.5 |
| 3,703,805 | 11/1972 | Ganter et al. | 58/85.5 |
| 3,710,567 | 1/1973 | Cleusix | 58/85.5 |
| 3,775,965 | 12/1973 | Besson et al. | 58/58 |

*Primary Examiner*—Samuel Scott
*Assistant Examiner*—A. Russell Burke

[57] ABSTRACT

A driving mechanism for a day and date calendar device comprising two Maltese crosses from which one activates the display of the days and the other the display of the dates. One of said Maltese crosses includes a magnetic clutch serving as disconnecting-gear when the date indication only is changed.

10 Claims, 2 Drawing Figures

DRIVING MECHANISM FOR DAY-DATE CALENDAR DEVICE

BACKGROUND OF THE INVENTION

Mechanisms for correcting and driving day-date calendar devices are well-known and used in watches. Most of these known mechanisms are not designed for the use in electronic wrist watches presenting quartz crystals as time-keeping elements. Therefore, since in electrical and electronic watches the energy for driving additional devices such as, for instance, a calendar showing the date and the day of the month is very small, these mechanisms cannot be used in this kind of watch.

SUMMARY OF THE INVENTION

The present invention provides a mechanism for driving day-date calendar devices with a minimum of power and as few components as possible.

In accordance with the present invention, there is provided a mechanism which allows an independent correction of the date indication without influencing the indication of the other displays.

The mechanism of the invention employs two Maltese crosses, one activated by the other and each serving to drive a disc showing, respectively, the date and the day.

DETAILED DESCRIPTION OF THE INVENTION

Figure 1:
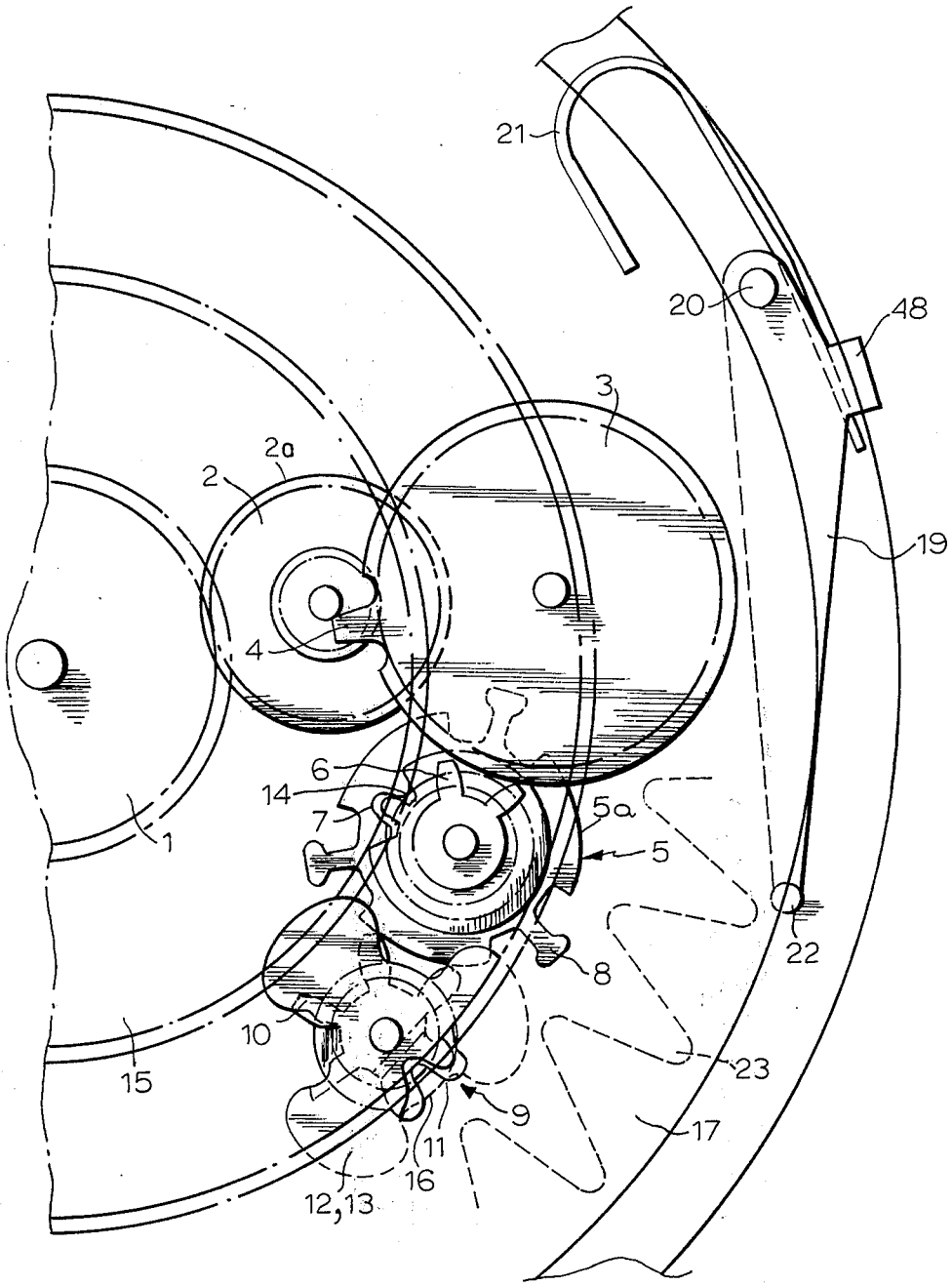
FIG. 1 is a view from the back of a watch illustrating an embodiment of a mechanism according to the invention.
Figure 2:
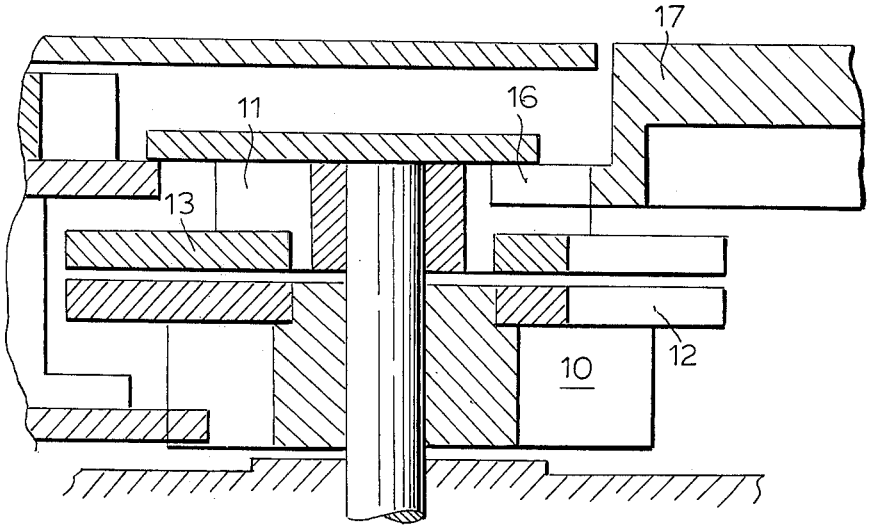
FIG. 2 is an enlarged side view showing the structure of a magnetic clutch according to the instant invention.

Referring specifically to the drawings, a driving mechanism for day and date calendar devices as shown in the figures comprises a double setting wheel 2 which is driven by an hour wheel 1 which is a part of a watch movement. The double setting wheel 2 has a gear 2*a* coaxial therewith and rigidly attached thereto which drives a wheel 3. The wheel 3 includes a driving finger 4 projecting therefrom which engages a first Maltese cross 5. Said first Maltese cross 5 presents two coaxial toothings 6 and 7 which are rigidly associated. The first Maltese cross 5 also includes a plate rigidly associated therewith having three fingers 8 and three non-driving segments 5*a*. The fingers 8 engage a second Maltese cross 9 comprising also two toothings 10 and 11. The toothings 10 and 11 are coaxial but rotate independent of one another. Two magnetic plates or pieces 12 and 13 are rigidly connected to one of said toothings 10 and 11, respectively. The magnetic pieces 12 and 13 form a magnetic clutch so that rotation of the toothing 10 rotates the magnetic piece 12 which in turn rotates the magnetic piece 13 due to magnetic coupling therebetween. The magnetic piece 13 rotates the toothing 11 since the toothing 11 is rigidly secured thereto.

The wheel 3 which is driven by the double setting wheel 2 through gear 2*a* effects one rotation in twenty-four hours and thereby activates once a day the first Maltese cross 5 by engaging finger 4 with toothing 6. The toothing 6 of said Maltese cross 5 is formed by six teeth and the driving finger 4 is long enough so as to act on the toothing 6, so that the Maltese cross 5 rotates once a day by 120°. This rotation is sufficient to shift a day disc 15 by an angle corresponding to a change of indication. The disc 15 has a toothing 14 which meshes with the toothing 7 of the first Maltese cross 5 so as to positively position the disc 15 in accordance with the position of toothing 6 which is driven by the single finger 4 which projects from the rim of the wheel 3. While the first Maltese cross 5 is rotated by the driving finger 4, one of the fingers 8 meshes with the toothing 10 and rotates the second Maltese cross 9 by an angle of 120°. The latter activates the magnetic clutch formed by the two magnetic pieces 12 and 13 which rotate a date disc 17 upon meshing toothings 11 and 16 on the magnetic piece 13 and disc 17, respectively. The rotation of said disc 17 needs only a small amount of energy to overcome frictional inertia, because it is freely rotatable and is not positioned by any resetting spring. Its proper positioning is guaranteed by the constant meshing of the toothings 11 and 16 and by binding of the toothing 10 with one of said segments 5*a* of the first Maltese cross 5. Since only a small amount of energy has to be transmitted to the date disc 17 to rotate the date disc, the magnetic clutch formed by the two identical pieces 12 and 13 need not be very strong.

The date disc 17 shows, as usual, numbers corresponding to the days of the month. In other words, it shows the numbers one through 31. Consequently, the calendar has to be corrected at the end of each month having less than 31 days. In the mechanism according to the illustrated embodiment of the invention, this correction can be effected by pressing a push-button 18 which is a part of a date correcting lever 19. The lever 19 rotates about a point 20 and usually is normally held disengaged by a resetting spring 21 in the position shown in the drawing. Upon pushing button 18, which projects from the watch case (not shown), the bent part or stud 22 of the lever 19 engages an external toothing 23 rigidly attached to the date disc 17 abd rotates the date disc by an angle corresponding to a change of the date indication.

Rotation of the date disc 17 causes the toothing 16 to drive the toothing 11 meshed therewith which rotates the magnetic piece 13. Due to the fact that the toothing 10 of the other magnetic piece 12 of said Maltese cross 9 engages and binds with or is locked by one of said segments 5*a* of the plate of the first Maltese cross 5, the toothing 10 and other magnetic piece 12 do not follow the rotation of the first magnetic piece 13 and no rotation is transmitted to said first Maltese cross 5. Therefore, no rotation whatever resulting from the correction of the date is transmitted to the wheel 3 or consequently to the driving motor (not shown) of the watch. The mechanism according to the invention thus eliminates any perturbation of the normal working of the watch resulting from the correction of the date indication.

In summary, the Maltese crosses 5 and 9 may be defined as intermittent motion mechanisms which are rotated by the hour wheel 1 through the setting wheel 2. The Maltese cross 5 converts the continuous rotary motion of the hour wheel into intermittent motion which is transmitted positively to the day calendar wheel or day disc 15 and by the magnetic pieces 12 and 13 to the date calendar wheel or date disc 17. The segments 5*a* bind with the toothing 10 to prevent transmission of motion to Maltese cross 5, but cooperate with fingers 8 to allow fingers 8 to drive the toothing and thus index the date disc 17. Binding of the toothing 10 and non-driving segments 5*a* allows the magnetic clutch plate 12 to slip relative to the magnetic clutch plate 13, thereby allowing one to index the date disc 17 without affecting the day disc 15.

It is obvious that the mechanism as shown can be modified in many ways so as to be incorporated into all types of watches, i.e., conventional mechanical watches, electrical and electronic watches and clocks. It is easily possible to transform it in a way so as to permit a positive and a negative change of the date.

What is claimed is:

1. A mechanism for driving a day and date calendar indication means of a watch, comprising:

means (1, 2) for transmitting continuous rotary motion;

means (5) for converting said continuous rotary motion into intermittent rotary motion;

a rotatable day calendar (15);

means (5) for transmitting said intermittent rotary motion to index the rotatable day calendar (15);

a rotatable date calendar (17);

clutch means (12, 13) disposed between said rotatable date calendar (17) and said converting means for transmitting motion to index said date calendar when said day calendar is indexed; and means for blocking transmission of motion from said date calendar to said day calendar so that said date calendar may be indexed independently of said day calendar.

2. The mechanism of claim 1, wherein said clutch means further includes a pair of members (12, 13) having a magnetic force of attraction existing therebetween, one of which (12) is positively driven by said means for transmitting said intermittent rotary motion to said day calendar (15) and the other of which (13) positively drives said date calendar (17) due to said magnetic force of attraction.

3. The mechanism of claim 1, wherein the rotatable date calendar includes a sequence of cam surfaces therearound, each of which corresponds to a date and wherein means are provided for pushing the cam surfaces to thereby index the date calendar independent of said day calendar.

4. A mechanism for driving a day and date calendar indication means of a watch, comprising:

means (1, 2) for transmitting continuous rotary motion;

means (5) for converting said continuous rotary motion into intermittent rotary motion;

a rotatable day calendar (15);

means (5) for transmitting said intermittent rotary motion to index the rotatable day calendar;

a rotatable date calendar (17);

clutch means (12, 13) disposed between said rotatable date calendar (17) and said converting means for transmitting motion to index said date calendar (17) when said day calendar is indexed, said clutch means including a pair of members (12, 13) having a magnetic force of attraction existing therebetween, one of which (12) is positively driven by said means for transmitting said intermittent rotary motion to said day calendar (15) and the other of which (13) positively drives said date calendar (17) due to said magnetic force of attraction; and means for blocking transmission of motion from said date calendar to said day calendar so that said date calendar may be indexed independently of said day calendar, said means for blocking transmission of motion including a segmented wheel positively rotatable with said means (5) for transmitting intermittent rotary motion, said segmented wheel (3) including driving teeth (8) spaced by non-driving segments (**5*a*), said driving teeth (8) engaging and moving a gear in said clutch means (12, 13**) which binds with said non-driving segments when rotated thereagainst, but allows said segments to rotate upon rotation of said means for transmitting intermittent rotary motion.

5. The mechanism according to claim 4, in which one (9) of said Maltese crosses (5, 9) is provided with two coaxial parts from which one is formed by a toothing (10) cooperating with a plate of the other Maltese cross (5) and by one of said magnetic pieces (12), while the other (5) is formed by a tooth meshing with a toothing (16) of a date disc on said date indication means (17) and by the other of said magnetic pieces (13).

6. The mechanism according to claim 5, in which said first Maltese crosses (5) is formed by a toothing (7) with six teeth cooperating with said wheel (3) by a finger (4) on said wheel (3) and one of said toothing (7) meshing with a toothing of a day disc on said day indication means (15).

7. The mechanism according to claim 5 including a double setting wheel (2) driven by the hour wheel (1) of said watch, a driven wheel (3) rotatably mounted in said watch and having a driving finger 4 cooperating with said first Maltese cross (5), said first Maltese cross having two toothings (6, 7) and a plate with three fingers (8) and three non-driving segments (**5*a*), one of said fingers (8) engaging said second Maltese cross (9) whereby said driven wheel (3) is driven by said double setting wheel (2) so as to rotate once completely in 24 hours and activate said first Maltese cross (5**) once a day.

8. The mechanism according to claim 4, further including means (19) for correcting said date calendar independently of said day calendar, wherein said means (19) isolates said date calendar from said day calendar through said magnetic clutch and said Maltese crosses.

9. A mechanism for driving a day and date calendar indication means of a watch, comprising:

means (1, 2) for transmitting continuous rotary motion;

means (5) for converting said continuous rotary motion into intermittent rotary motion;

a rotatable day calendar (15);

means (5) for transmitting said intermittent rotary motion to index the rotatable day calendar (15);

a rotatable date calendar (17);

clutch means (12, 13) disposed between said rotatable date calendar (17) and said converting means for transmitting motion to index said date calendar (17) when said day calendar (15) is indexed, said clutch means including a pair of members (12, 13) having a magnetic force of attraction existing therebetween, one of which (12) is positively driven by said means for transmitting said intermittent rotary motion to said day calendar (15) and the other of which positively drives said date calendar (17) due to said magnetic force of attraction; and means (**10, 5*a*) for blocking transmission of motion from said date calendar (17) to said day calendar (15) so that said date calendar (17) may be indexed independently of said day calendar, said means for blocking transmission of motion including a segmented wheel positively rotatable with said meams for transmitting intermittent rotary motion, said segmented wheel including driving teeth (8) spaced by non-driving segments (5***a*), said driving teeth (8) enagaging and moving a gear in said clutch means which binds with said non-driving segments (5*a*) when rotated thereagainst, but allows said segments (5*a*) to rotate upon rotation of said means for transmitting intermittent rotary motion.

10. The mechanism of claim 9, wherein the rotatable date calendar includes a sequence of cam surfaces therearound, each of which corresponds to a date and wherein means are provided for pushing the cam surfaces to thereby index the date calendar independent of said day calendar.

* * * * *

UNITED STATES PATENT OFFICE

CERTIFICATE OF CORRECTION

PATENT NO. : 3,969,888

DATED : July 20, 1976

INVENTOR(S) : Cyril Vuilleumier et al

It is certified that error appears in the above-identified patent and that said Letters Patent are hereby corrected as shown below:

On page 1, in the preamble, Section [76]

"Veuilleumier" to --Vuilleumier--

Signed and Sealed this

Second Day of November 1976

[SEAL]

*Attest:*

RUTH C. MASON
*Attesting Officer*

C. MARSHALL DANN
*Commissioner of Patents and Trademarks*